United States Patent [19]

Capecchi

[11] Patent Number: 4,587,385

[45] Date of Patent: May 6, 1986

[54] TOUCH PAD INDICATING ARRIVAL DURING SWIMMING CONTEST

[76] Inventor: Augusto Capecchi, Via Byron 16, Genoa, Italy

[21] Appl. No.: 632,610

[22] Filed: Jul. 18, 1984

Related U.S. Application Data

[63] Continuation-in-part of Ser. No. 165,742, Jul. 3, 1980, Pat. No. 4,476,358, which is a continuation of Ser. No. 341, Jan. 2, 1979, abandoned.

[51] Int. Cl.[4] ..... H01H 3/02; H01H 35/00; A63K 3/00

[52] U.S. Cl. ..... 200/52 R; 200/86 R; 272/4

[58] Field of Search ..... 200/52 R, 86 R; 272/4

[56] References Cited

U.S. PATENT DOCUMENTS

| | | | |
|---|---|---|---|
| 459,984 | 9/1891 | Wilson | 200/86 R |
| 3,784,768 | 1/1974 | Hunt | 200/86 R X |
| 3,916,214 | 10/1975 | Coble, Jr. et al. | 200/52 R X |
| 4,475,016 | 10/1984 | Berger | 200/86 R X |
| 4,476,358 | 10/1984 | Capecchi | 200/52 R |

*Primary Examiner*—J. R. Scott

[57] ABSTRACT

A non-water-tight touch pad for swimming competitions mounted partially submersed on the finishing wall of a swimming pool. The pad includes two plates located in front of each other. The front plate is perforated plastic material and is loosely inserted in a frame consisting of channel sections on the four sides and movable towards the metal back plate.

Resting between the two plates, a plurality of parallel metal strips are mounted on the back metal plate but remain insulated from the back metal plate while connected to each other. A number of conductive springs shaped as seagull wings are welded on each parallel strip. These springs are mounted perpendicularly to the strips and act as spacers between the two plates and act as electric movable contacts between strips and the rear plate as soon as any pressure is applied on the front plate.

A plurality of plastic levers are mounted on the upper side of the touch-pad permitting a vertical force exerted by a backstroke swimmer to be tranferred to the sensitive front plate.

2 Claims, 5 Drawing Figures

TOUCH PAD INDICATING ARRIVAL DURING SWIMMING CONTEST

CROSS REFERENCE TO RELATED APPLICATIONS

This application is a continuation-in-part of application Ser. No. 06/165,742, filed July 3, 1980, now U.S. Pat. No. 4,476,358 which is a continuation of application Ser. No. 06/000,341, filed Jan. 2, 1979, now abandoned.

SUMMARY OF THE INVENTION

This invention contains two modifications of my earlier invention disclosed in U.S. Pat. No. 4,476,358. In particular one of the two elements of the electric contact, previously consisting of pairs of metal strips mounted on the isolated back plate, is now replaced by a metal back plate. In addition a plurality of plastic levers are fitted next to each other on the upper side of the frame of the pad, so as to transfer to the front plate any vertical force exerted by a backstroke swimmer.

DESCRIPTION OF THE INVENTION

Figure 1:
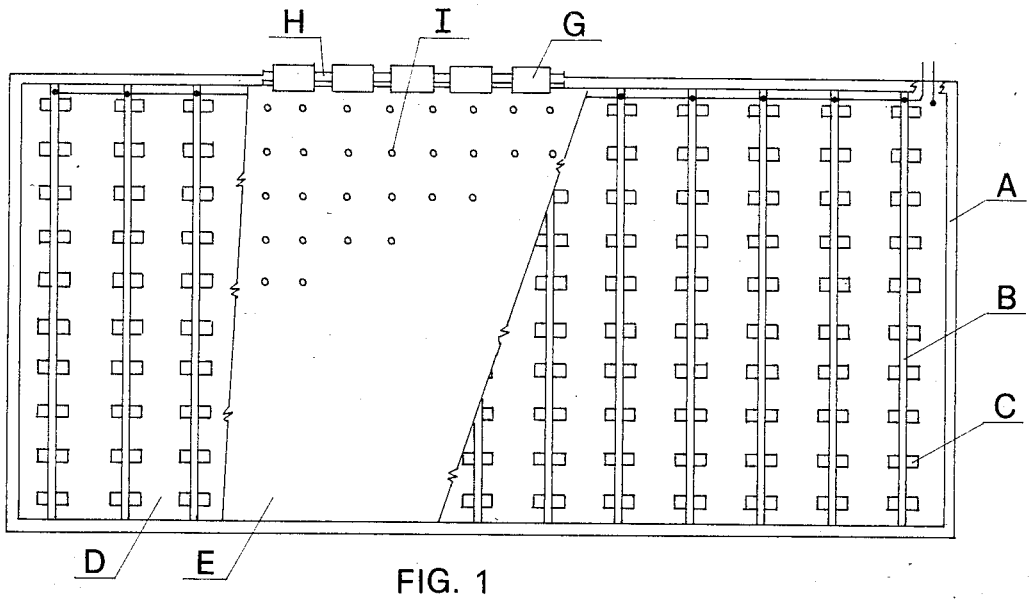
FIG. 1 shows a front view of the pad with the perforated plate partially removed.
Figure 2:
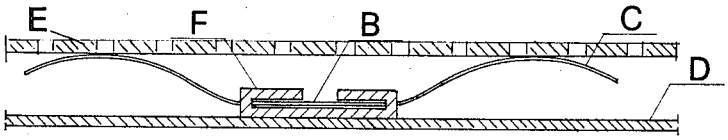
FIG. 2 is an amplified view of one strip and spring.
Figure 3:
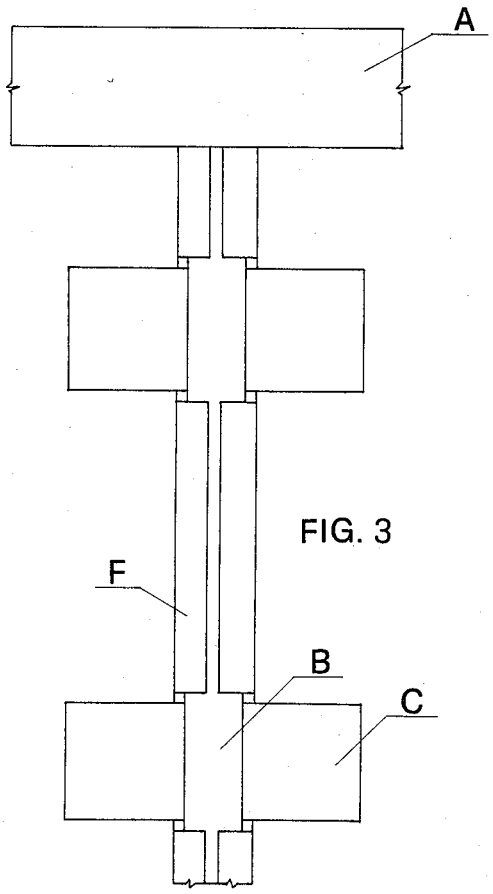
FIG. 3 is a front view of a strip with two springs and insulating sheath.
Figure 4:
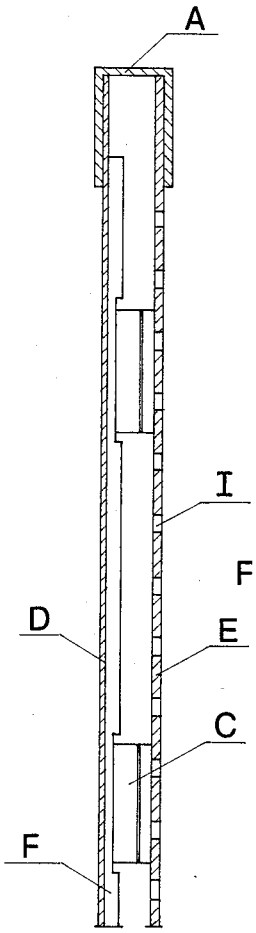
FIG. 4 is a cross section showing the two plates, seagull wing shaped spacers and the frame.
Figure 5:
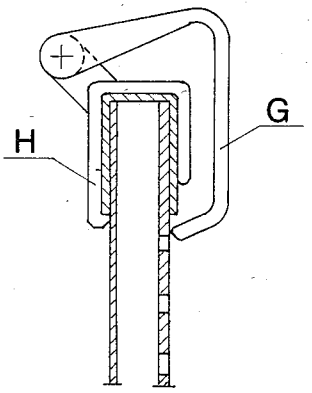
FIG. 5 is a side view of the levers mounted on the upper side of frame.

Compared with other known types, the invention has the following characteristics:

(1) the signal is transmitted without any delay, unlike other systems;

(2) the sensitivity of the pad is quite a constant over its entire surface, since its operating principle is based on the use of approximately 500 mechanical contacts;

(3) it requires no sealed envelope which might cause seepage during a prolonged length of time;

(4) even strong localized forces may be applied without causing damage;

(5) the pad is insensitive to wave motion;

(6) contacts are of the self-cleaning type.

The technical particulars of the invention are outlined hereinafter.

The pad is composed of two plates located face to face, the back plate "D" being made of conductive metal, resting against the vertical wall of the swimming pool, whereas the front plate "E" consists of a plastic sheet with perforations "I" over its entire surface so as to reduce the front plate's resistance to motion in water. The front plate is loosely inserted in a frame "A" consisting of channel sections on the four sides and movable towards the metal back plate.

A contact/spacer spring system is mounted on the back plate covering its whole surface as illustrated in the drawings. The metal strips "B" are mounted, but insulated by rubber sheaths "E", onto the back metal plate whereas the metal contact springs "C" are welded onto strips "B".

The contact springs "C" have a dual purpose: they must close the contact between the strips "B" and the back plate "D" under external forces applied to the perforated sheet "E" and they must serve as an elastic spacers between the two plates "D" and "E".

Furthermore, the contact springs have a self-cleaning action on the contact areas, due to the flattening of their terminal sections.

It should be noted that any pressure on the plate "E" will cause its local deformation and the transfer of the force onto the contact springs nearest to the pressure point. In this way, almost the whole thrust applied by the swimmer is transferred to the contact springs.

While swimming on his back, the swimmer's arms may strike vertically the pad on the upper side where there is no reaction; to obviate this lack of sensitivity, a plurality of plastic levers "G", horizontally pivoting on plastic "H" elements mounted on the upper side of the frame, will permit these striking actions to the front plate "F" thus achieving an electric connection.

The electrical impedance of the water immersed pad depends on various factors, but its operation is always achieved by impedance variation caused by closing of one or more contact springs "E" between the strips "B" and the plate "D".

The voltage and frequency of the energy supply will be determined after tests are carried out in practical environment conditions.

In its practical implementation, the invention may also take shapes other than described above. For instance the configuration and arrangement of the elastic elements and strips, as well as plastic levers may be changed, while remaining within the scope of this Patent.

I claim:

1. A touch pad for swimming pool competitions, to be mounted partially submerged on the finishing wall of a swimming pool consisting of:

a metal back plate to be mounted adjacent said pool finishing wall, a resilient plastic perforated front striker plate located in front of said metal back plate, free flow of water being allowed through said front striker plate, and between said front striker plate and said metal back plate, a frame attached to said back plate for loosely mounting said front striker plate to allow movement of said front striker plate toward said metal back plate when touched by a swimmer, a plurality of parallel conductive strips mounted onto said metal back plate but electrically insulated by sheath means from said metal back plate, said conductive strips being electrically connected to each other, a plurality of conductive contact springs welded onto said conductive strips, shaped as seagull wings to act as resilient spacers between said front striker plate and said metal back plate and to act as self cleaning electrical contacts between said conductive strips and said metal back plate.

2. A touch pad for swimming competitions as disclosed in claim 1 further including a plurality of plastic levers horizontally pivoted on plastic elements mounted side by side on the upper side of said frame of said pad, said plastic levers transferring a force vertically exerted by a backstroke swimmer to said front striker plate.

* * * * *